US009079087B2

(12) United States Patent
Topolosky

(10) Patent No.: US 9,079,087 B2
(45) Date of Patent: Jul. 14, 2015

(54) DEVICE FOR ADJUSTING THE CIRCUMFERENCE OF SMALLER CUPS TO REST IN LARGER

(71) Applicant: Gary P. Topolosky, Pittsburgh, PA (US)

(72) Inventor: Gary P. Topolosky, Pittsburgh, PA (US)

( * ) Notice: Subject to any disclaimer, the term of this patent is extended or adjusted under 35 U.S.C. 154(b) by 0 days.

(21) Appl. No.: 14/149,775

(22) Filed: Jan. 7, 2014

(65) Prior Publication Data

US 2014/0224816 A1 Aug. 14, 2014

Related U.S. Application Data

(60) Provisional application No. 61/749,474, filed on Jan. 7, 2013.

(51) Int. Cl.

| | |
|---|---|
| ***A63B 67/06*** | (2006.01) |
| ***A63B 67/00*** | (2006.01) |
| ***A63B 63/08*** | (2006.01) |
| ***A63F 7/00*** | (2006.01) |

(52) U.S. Cl.

CPC ..... *A63B 67/06* (2013.01); *A63B 63/08* (2013.01); *A63F 7/0017* (2013.01); *A63B 2210/50* (2013.01); *A63F 2250/024* (2013.01)

(58) Field of Classification Search

USPC ..... 220/737, 694, 703, 710.5, 738, 669, 220/646; 206/217; 248/311.2, 315, 318

See application file for complete search history.

(56) References Cited

U.S. PATENT DOCUMENTS

| | | | | |
|---|---|---|---|---|
| 2,327,078 | A * | 8/1943 | Teetor | 220/23.83 |
| RE30,326 | E * | 7/1980 | van Buren, Jr. | 220/326 |
| 4,928,873 | A * | 5/1990 | Johnson | 220/738 |
| 7,805,959 | B2 | 10/2010 | Webb et al. | |
| 8,028,995 | B2 | 10/2011 | Hoffer | |
| 8,146,921 | B2 | 4/2012 | Lombardi | |
| 8,235,389 | B1 | 8/2012 | Herro et al. | |
| 2006/0027971 | A1 | 2/2006 | Radhakrishnan | |
| 2011/0220665 | A1 | 9/2011 | McDonnell et al. | |
| 2012/0225742 | A1 | 9/2012 | Max et al. | |
| 2012/0256378 | A1 | 10/2012 | Brown | |
| 2013/0213987 | A1 * | 8/2013 | Drutz | 220/738 |
| 2014/0251494 | A1 * | 9/2014 | Stieger et al. | 141/1 |

* cited by examiner

*Primary Examiner* — Robert J Hicks
*Assistant Examiner* — Kareen Rush
(74) *Attorney, Agent, or Firm* — Gary P. Topolosky

(57) ABSTRACT

An adapter device that enables smaller drinking cups to fit within larger drinking cups by adjusting the circumference of the smaller cups at or near the small cup rim. Alternately, a sleeve on the smaller cup sidewall allows it to rest nearly flush inside a larger cup for multi-levels of alcohol consumption. These devices can be removed for reuse and/or collected during game play.

19 Claims, 2 Drawing Sheets

DEVICE FOR ADJUSTING THE CIRCUMFERENCE OF SMALLER CUPS TO REST IN LARGER

CROSS-REFERENCE TO RELATED APPLICATION

This is a perfection of U.S. Provisional Application Ser. No. 61/749,474, filed on Jan. 7, 2013, the disclosure of which is fully incorporated by reference herein.

BACKGROUND OF THE INVENTION

The present invention relates to the popular drinking game known as beer pong, apparently known in some locations as "Beirut". It involves bouncing pingpong balls on a flat surface into a series of standard party/beer drinking cups containing beer or another liquid beverage. Depending on the rules established before a game starts, if one lands her/her bounced ping pong ball into a cup, the bouncing player can either drink the cup contents or dictate that another player of his/her choice drink. The empty cup is removed leaving fewer targets to aim for. See also, Radhakrishnan U.S. Published Application No. 2006/0027971 for other rule variations.

The game has become so well known that there are college pong leagues and intercollegiate teams. Sophisticated pong-related devices have been disclosed including the table with cooling system of Herro et al U.S. Pat. No. 8,235,389, and electromechanical moving target table from Hoffer U.S. Pat. No. 8,028,995. There's an arcade game version per Lombardi U.S. Pat. No. 8,146,921. And the elaborate apparatus of Max et al U.S. Published Application No. 2012/0225742 includes a rounded backboard on a stand with netting. While the latter showed different sized holes, not all are meant to hold standard size drinking cups.

Numerous other pong-playing accessories have been disclosed. These include the cup holder of Webb et al U.S. Pat. No. 7,805,959 and pong cup arranging device of McDonnell et al U.S. Published Application No. 2011/0220665. A portable table, that also floats, is the subject of Brown U.S. Published Application No. 2012/0256378.

The typical pong playing cup in a 10, 12, or 16 oz. size made from polystyrene is most often aligned on a flat table, or situated like the 10 pins of bowling (rows of 1, 2, 3 and then 4) into holes for suspending from the cup rims. Red cups of these ilk are so popular as to justify country song lore. See, Toby Keith's "Red Solo Cup". These "larger" size cups are not meant to be filled to the brim with beer during play. A bounced pong ball is only meant to land in a cup half filled or less for the winning bouncer to drink from or designate somebody else to drink empty. For hard liquors (and even semi-solid drinks (like Jello® shots), these cups are too large. A typical shot glass would hold much less alcohol, whether its whiskey, rum, gin or numerous other alternatives.

What is needed is a device for situating on or about smaller drinking disposable cups, of the 5, 7 or 8 oz. variety, most often clear and made from PET, for situating IN the standard larger pong drinking cup. This invention addresses that need with Pong Size Adapters or "PSA's", more affectionately referred to herein as Rimjob adapters or Rimjobs™.

SUMMARY OF THE INVENTION

It is an object of this invention to provide devices letting smaller drinking cups fit inside larger drinking cups for multi-levels of alcohol consumption. It is another object to provide such devices for reuse or for removal and collection during a typical game play. It is another main object of this invention to provide devices as color coordinated collectibles, and/or for use by alcohol and other product/service advertising.

BRIEF DESCRIPTION OF DRAWINGS

Further features, objectives and advantages will become clearer with the detailed description made with reference to the accompanying drawings in which.

DETAILED DESCRIPTION OF PREFERRED EMBODIMENTS

Figure 1:
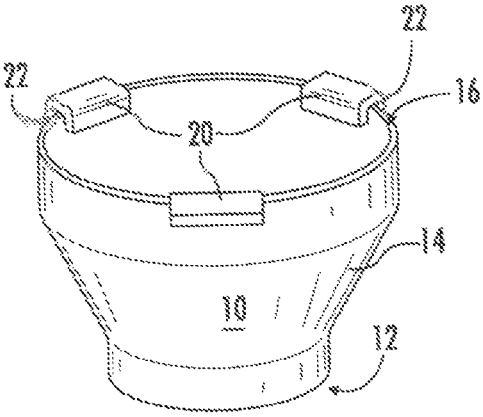
FIG. 1 is a top perspective view of a first embodiment of the invention, showing spaced apart clips to the rim of a standard size, small plastic cup.

Referring now to the drawings, there is shown several embodiments of device, according to the invention. In the accompanying drawings, common elements are commonly numbered in the respective views. For the alternative embodiments, common elements are consistently numbered though in the next hundred series.

With the present invention, smaller diameter cups (for serving drinks other than beer) can be fitted at or around their top cup perimeter (rim) with lipped spacers/clips affixed at at least 120 degree points for sitting/situating in the confines of a larger, standard beer pong/drinking cup. This variety of Rimjob is shown in accompanying FIG. 1. More particularly, smaller clear plastic cup 10 has a flat base 12 with a curved sidewall 14 that terminates in top rim 16. In the first embodiment of this invention, there are situated at least 3 individualized Rimjob clips, generally 20, each clip being generally U-shaped with a slit or slotted bottom 22 for sitting directly on a section of top rim 16 to cup 10. Depending on the overall length of each clip, they may have some flexibility and/or some intentional curvature added so as to better fit along longer sections of cup rims.

Figure 5:
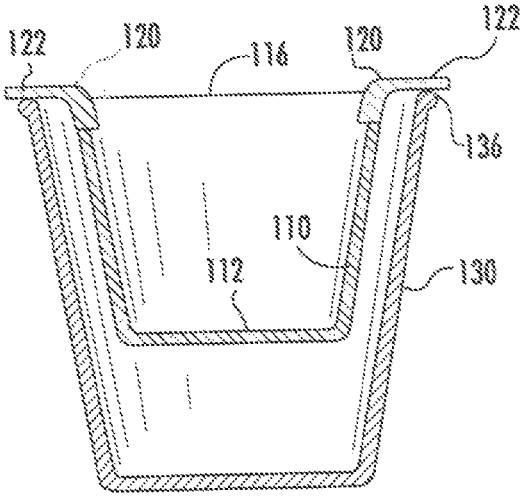
FIG. 5 is a sectional view of a top mounted device affixed to a cup situated along the upper rim to the larger cup according to one embodiment of this invention.

In an alternate variation, better seen in cross-section at FIG. 5, those plurality of clips 120 each have an outermost ledge 124, preferably planar in cross-section, for more easily resting that inner cup 110 onto the uppermost rim of beer cup 130, at least on its uppermost rim 136. FIG. 5 shows, in cross-section, how a top-situated Rimjob will rest in and along the normal sipping top of a standard sized beer cup. That particular Rimjob shown in FIG. 5 would resemble this cross-sectional view if comprised of four lipped spacers 90 degrees apart (rather than the 120 degree spacings for a 3-lipped variety). Alternately, it would look the same, in partial cross-section, if actually comprised of a single clip, all-around the rim (one piece) variety, described in more detail hereinbelow.

Figure 2:
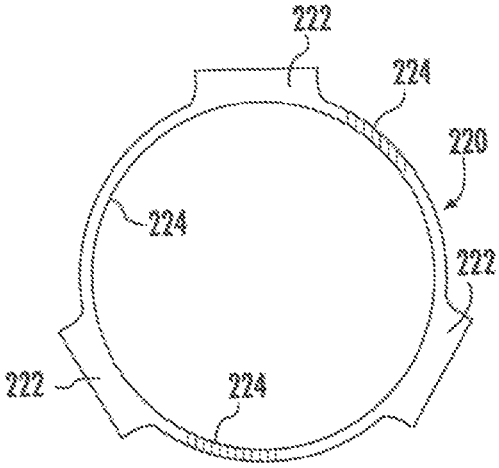
FIG. 2 is a top plan view of a second embodiment, showing the whole rim surround variation with three spaced apart, drink sipping areas.
Figure 3:
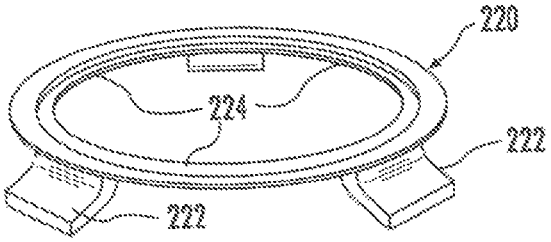
FIG. 3 is a bottom perspective view of the embodiment from FIG. 2 wherein can be seen the groove into which the whole top rim of a small cup is situated.

Because multiple spacer clips might pose a choking hazard (regardless of the degree of sobriety of its user), it is advisable to instead provide smaller cups with a full perimeter surround, i.e., one that goes completely about the upper rim of a smaller disposable shot or mixed drink cup such as one that holds 5, 6 or maybe up to 8 oz. of liquid (read "liquor"). See especially, FIGS. 2 and 3.

Rather than provide a full lip completely around the small, interior cup, one that may be difficult to easily sip the contents from, it is suggested that a full surround, upper lid version, generally 220 have a plurality of overhang regions 222 with three or more spaced sipping regions 224 there between. One way to accomplish same would be to provide a full rim surround 220 with three, possibly four, spacer extensions/protrusions 222 like the version shown in top view at FIG. 2 and in an inverted, perspective view at FIG. 3.

Figure 4:
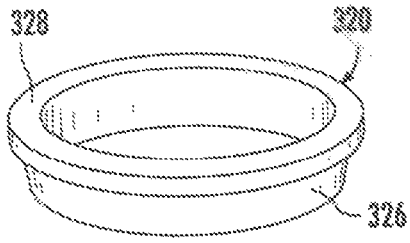
FIG. 4 is a top perspective view of a third embodiment, a whole rim surround but with no sipping area "cutouts", said embodiment also illustrating the inclusion of a message atop a portion of the rim circumference.

If properly constructed from a fuller, thicker "band" of material, a sip-around clip 320 for fitting about the entire top of a small plastic drinking cup/glass may be used as per FIG. 4. That clip may be rimmed so that its lower outer half 326 rests fully inside the upper rim interior of the smaller cup. OR, it may be similarly slotted (not shown) as were the three respective U-shaped clips better seen in FIG. 1.

This variety of FULL Rimjob clip provides a flat surface 328 on which can be printed advertisements promoting brands and/or various customer products/services including liquid/mixer products, Pong accessories, or munchies and numerous other food products. That space atop Rimjob 320 may contain beer or other alcoholic company promotions, PSA messages, or sales/redemption coupons. Alternately, it may be banded with various professional sports team colors/logos and/or customized for various college mascots and school colors.

Figure 6:
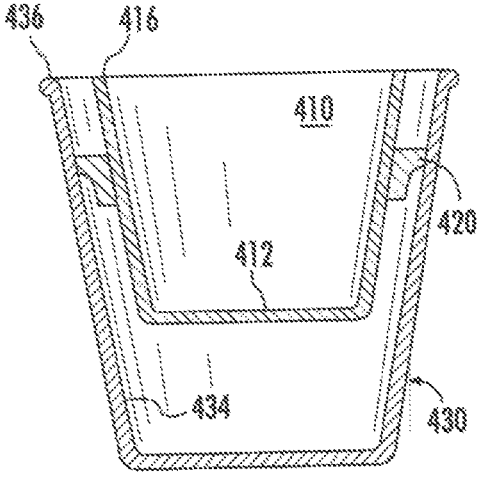
FIG. 6 is a sectional view of the alternate mounting means in which a spacer is situated along the midwall of the smaller cup giving the game play a potentially tougher target with several cups having multiple rims to navigate one's ping pong balls bounces around.

FIG. 6 shows in cross-section yet another variation of Rimjob cup clip 420, this one meant to rest along and about the sidewall 414 to smaller drinking cup 410 so as to temporarily "wedge" smaller cup 410 inside but comfortably against the innermost sidewall 434 to larger sized cup 430 . . . without having to rest on any portion of the larger cup's upper lip/ledge.

Figure 7:
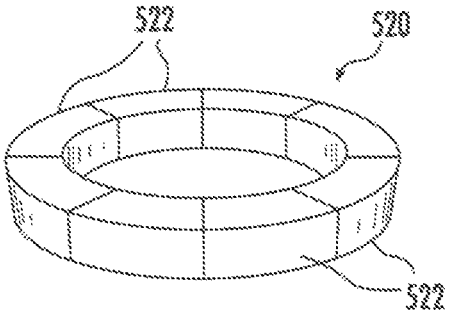
FIG. 7 is a top perspective view, in black and white, showing a preferred embodiment of device which is segmented with multiple arcuate shapes interconnected by elastic means so as to: (1) sufficiently spread for fitting about the midwall of a smaller cup; and then, fitting about a player's body part as a "trophy" upon emptying of the cup's contents.
Figure 8:
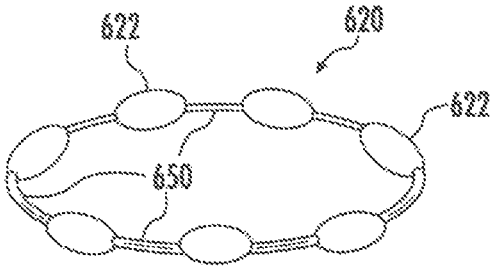
FIG. 8 is a top perspective view of an alternate variation of FIG. 8 showing a plurality of beads interconnected on a display band.

Two versions of that midwall spacer variety of Rimjob are shown in more detail in the next two views. FIG. 7 shows one variety 520 on an elastic band (not seen) threaded through the various subsections 522 of clip 520. That Rimjob consists of multiple arches which, when closed together, resemble a more circular-shaped band or bracelet variety. After stretching over a player's body part (wrist, ankle, etc.), this Rimjob would be able to snap back into shape thereby providing mathematical evidence of how many Rimjobs were "won"/earned during a given night of play. When asked "how many Rimjobs did YOU get last night?", one need merely point to the collection of bands for the answer. FIG. 8 shows a simpler variation 620, consisting of multiple "beads" 622 about a more visible elastic band 650.

The varieties of Rimjobs that extend midway up the sidewalls to a standard clear cup, for fitting in the larger Red "Solo"® cup according to preferred embodiments, may have some sections of adhesive material (not shown) added to one or more segments. This will temporarily hold the Rimjob-ed cup in place long enough for a round of play without unduly interfering with that round, or with the subsequent wearing of such bands as "trophies".

The present invention may be used for showing school allegiance (i.e., choosing one set of school colors over another), loyalty to professional sports teams (i.e., Go Black-and-Gold) and/or particular brands (i.e., Budweiser, Rolling Rock, Heineken; and/or Captain Morgan Rum, Jack Daniels' whiskey, etc.). These devices can also include true public service announcement/messages like a "PLEASE PONG RESPONSIBLY" top surround.

Figure 9:
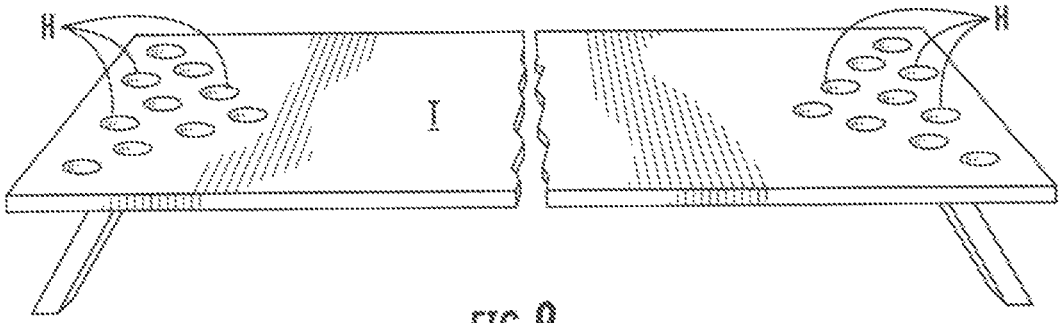
FIG. 9 is a top perspective view of a typical pong playing table with two opposed playing "courts" showing the typical 10 pin/cup arrangement at each end. In this case, the table includes 10 commonly sized holes arranged in rows of 1, 2, 3 and 4 for holding (at least midway) large drinking cups containing a beverage, most often beer.

With the Rimjobs of this invention, Pong playing can be instantly taken to newer levels of competition. One NOT need have modified playing boards/tables with different sized cup holes/holders to accomplish variable size drinking targets and differing contents therein. There can still be the standard table (element T in FIG. 9) each end of which has multiple cup holes H, like the 10 hole bowling-like arrangement depicted but with varying arrangements containing harder liquor targets in the smaller cups "Rimjob-ed" into one or more of the larger beer cups already situated in the playing "field". For instance, smaller cup varieties of whiskey, rum, gin, even Jello® shots, may be situated in alternating rows (the first and third; or second and fourth), in a diamond pattern or just the center hole (where bowling pin #5 sits, or the center 8 ball in a game of billiards). Alternately, the game can include a smaller shot-glass (with Rimjob) as just the front pin, a full back row of Rimjob containers or possibly have additional rows/holes to a competition table specially fitted with Rimjob alternatives.

What is claimed is:

1. A device adapted for enabling a smaller diameter cup to fit in a larger diameter cup during a drinking game, said device comprising:

three or more sections of clips that form a continuous band for resting at or near a top rim of the smaller diameter cup at multiple points 120 degrees or less apart about a circumference of the smaller diameter cup for enabling the top rim of the smaller diameter cup to rest substantially horizontally with a top rim of the larger diameter cup; wherein the sections of clips at least temporarily adhere to the smaller diameter cup.

2. The drinking cup adapter of claim 1, which consists of four or more sections of clips.

3. The drinking cup adapter of claim 1, which consists of six sections of clips spaced 60 degrees apart about the circumference of the smaller diameter cup.

4. The drinking cup adapter of claim 1 wherein adjacent sections of clips are connected to one another.

5. The drinking cup adapter of claim 1 wherein adjacent sections of clips are elastically interconnected.

6. The drinking cup adapter of claim 1 wherein the sections of clips rest at least partially on the top rim of the smaller diameter cup.

7. The drinking cup adapter of claim 1 wherein the sections of clips are at least temporarily affixed to the smaller diameter cup.

8. The drinking cup adapter of claim 7 wherein the sections of clips pin against the smaller diameter cup.

9. The drinking cup adapter of claim 1 wherein the sections of clips rest adjacent the top rim of the smaller diameter cup.

10. The drinking cup adapter of claim 1 wherein the sections of clips are arcuate-shaped.

11. The drinking cup adapter of claim 1 wherein the continuous band rests adjacent the top rim of the smaller diameter cup.

12. The drinking cup adapter of claim 1 wherein the continuous band rests atop the top rim of the smaller diameter cup.

13. The drinking cup adapter of claim 12, which includes one or more drink sipping cutout regions.

14. The drinking cup adapter of claim 1, which includes at least one of: a message, a sports or school logo and an advertisement.

15. The drinking cup adapter of claim 1, which can be removed and worn as a drink counting device.

16. The drinking cup adapter of claim 1 which consists of a plurality of spaced beads on a common elastic banding.

17. A device adapted for enabling a smaller diameter cup to fit in a larger diameter cup during a drinking game and which can be removed and worn as a drink counting device, said device comprising:

a plurality of clip sections that form a substantially continuous band for resting at or near a top rim of the smaller diameter cup for enabling the top rim of the smaller diameter cup to rest substantially horizontally with a top rim of the larger diameter cup with adjacent clip sections being connected to one another; wherein the sections of clips at least temporarily adhere to the smaller diameter cup.

18. The drinking cup adapter of claim 17 wherein the clip sections rest at least partially on the top rim of the smaller diameter cup.

19. The drinking cup adapter of claim 17, which includes at least one of: a message, a sports or school logo and an advertisement.

* * * * *